United States Patent [19]

Lautenschläger

[11] 4,152,811

[45] May 8, 1979

[54] OVER-CENTER HINGE

[75] Inventor: Gerhard Lautenschläger, Wersau, Fed. Rep. of Germany

[73] Assignee: Karl Lautenschläger KG, Möbelbeschlagfabrik, Reinheim, Fed. Rep. of Germany

[21] Appl. No.: 873,076

[22] Filed: Jan. 27, 1978

[30] Foreign Application Priority Data

Jan. 28, 1977 [DE] Fed. Rep. of Germany ..... 2703489

[51] Int. Cl.[2] ..... E05D 3/06

[52] U.S. Cl. ..... 16/164; 16/163

[58] Field of Search ..... 16/163, 164, 165, 166, 16/145, 180, 183

[56] References Cited

U.S. PATENT DOCUMENTS

| | | | |
|---|---|---|---|
| 3,744,086 | 7/1973 | Salice et al. | 16/164 |
| 4,065,829 | 1/1978 | Lautenschläger | 16/163 X |

FOREIGN PATENT DOCUMENTS

| | | | |
|---|---|---|---|
| 2408057 | 8/1975 | Fed. Rep. of Germany | 16/145 |
| 2536744 | 6/1976 | Fed. Rep. of Germany | 16/145 |
| 2303931 | 10/1976 | France | 16/164 |

*Primary Examiner*—Werner H. Schroeder
*Assistant Examiner*—Moshe I. Cohen

[57] ABSTRACT

Over-center hinge for cabinet doors, having two hinge links pivotingly joined, in the manner of a quadruple knuckle joint, at one end to a door-related hinge member and at the other end to a wall-related hinge member in the form of an elongated supporting arm, which, in the swing from the closed to the open position, can be moved through a dead center position on one side of which it is biased by the tension of a torsion coil spring toward the closed position and on the other side of which it is biased by the tension of the torsion coil spring toward the open position. The first leg of the torsion coil spring, disposed in the front terminal portion of the door end of the supporting arm, engages a prolongation on the supporting arm end of one of the hinge links, which forms with the pintle at the supporting arm end of this link a lever arm which is directed away from the pintle such that, when the hinge is in the closed position, it is biased for swinging in the closing direction and, when the hinge is in the open position, it is biased for swinging in the opening direction. The prolongation is provided on the outer hinge link farther from the supporting wall, and the torsion coil spring is disposed between the pivot axes on the supporting arm ends of the hinge links, the second spring leg not in engagement with the prolongation of the outer hinge link being supported directly or indirectly by the supporting arm.

2 Claims, 3 Drawing Figures

OVER-CENTER HINGE

BACKGROUND

Figure 1:
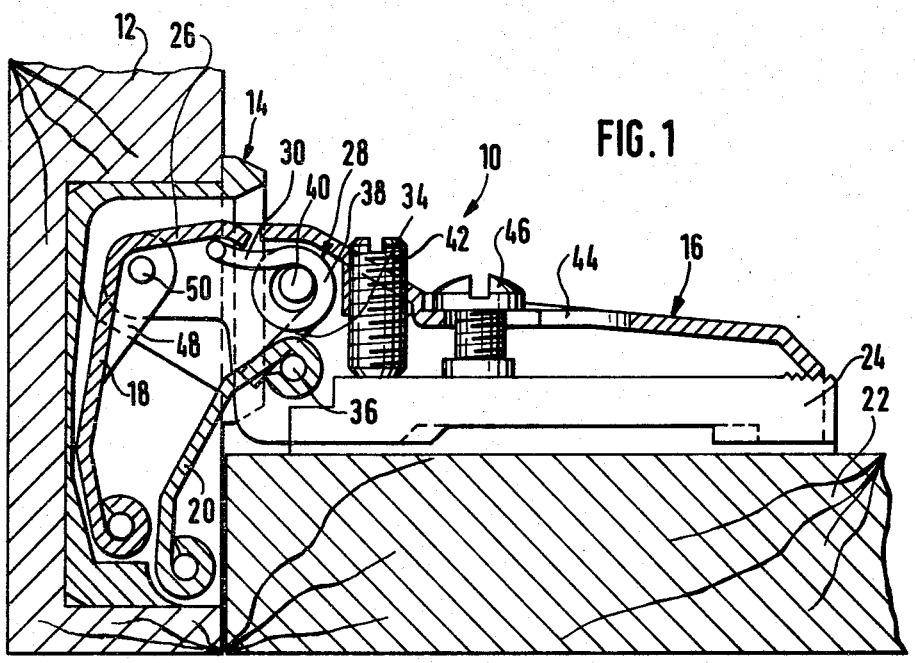

The invention relates to an over-center hinge for cabinet doors, having two hinge links pivotingly joined, in the manner of a quadruple knuckle joint, at one end to a door-related hinge member and at the other end to a wall-related hinge member in the form of an elongated supporting arm, which, in the swing from the closed to the open position, can be moved through a dead center position on one side of which it is biased by the tension of a torsion coil spring toward the closed position and on the other side of which it is biased by the tension of the torsion coil spring toward the open position, one end of the torsion coil spring, disposed in the front terminal portion of the door end of the supporting arm, engaging a prolongation on the supporting arm end of one of the hinge links, which forms with the pintle at the supporting arm end of this link a lever arm which is directed away from the pintle such that, when the hinge is in the closed position, it is biased for swinging in direction closing direction, and, when the hinge is in the open position, it is biased for swinging in the opening direction.

Such over-center hinges, which are biased by spring tension towards two stable end positions, have the advantage that a door mounted on a cabinet with such a hinge will not remain in intermediate positions, i.e., it will not remain half open, so as to be damaged by drawers disposed in the interior of the cabinet, such as drawers for pots or for provisions, or fold-out slides carrying kitchen appliances, in the case of kitchen cabinets, for example. Such an over-center hinge is known from German Offenlegungsschrift No. 21 17 828 in which, asise from a V-shaped leaf spring or wire spring, a torsion coil spring for the production of the spring bias is proposed, the spring being so disposed that the spirals of the torsion coil spring are looped about the pintle on the supporting arm end of the outer hinge link farther from the supporting wall, while the free end of one of the legs of the spring engages a projection on the terminal portion of the supporting arm end of the other, i.e., inner, hinge link, while the second leg of the spring thrusts against the supporting arm. The arrangement of the spirals of the torsion coil spring on the pivot pin of the outer hinge link results in a weakening of the hinge link in the articulation area, which gives rise to doubts with regard to endurance. Furthermore, the pivot point at the supporting arm end of the outer hinge link must be concealed in the supporting arm so that the spirals of the torsion coil spring will not be visible. But then this pivot point is hard to reach. Lastly, the known design has the additional disadvantage that the torque acting in the opening direction beginning from the dead center is relatively weak, so that it more or less merely helps in the overcoming of the bearing friction, but is not capable of automatically moving the door mounted with the hinge to the fully open position and holding it there.

THE INVENTION

The invention, therefore, is addressed to the problem of creating an over-center hinge of the kind concerned herein, whose over-center mechanism will have, over the entire angle of opening of a door mounted with the hinge, a sufficiently great opening or closing torque to move the door in every case all the way to the desired end position and hold it there. At the same time, any weakening of the hinge links by the over-center mechanism is to be avoided.

Setting out from over-center hinge of the initially described kind, this problem is solved in accordance with the invention in that the prolongation is provided on the outer hinge link further from the supporting wall, and that the torsion coil spring is disposed in the supporting arm between the pintles at the supporting arm ends of the hinge links, the second spring end, which does not engage the other hinge link projection, thrusting against the supporting arm.

In order to secure the torsion coil spring in the provided position within the supporting arm, provision is made in further development of the invention for it to be secured in the supporting arm by means of a pin disposed parallel to the pintles of the hinge links and carried through its coils. The pin is preferably riveted in bores in sidewalls provided on the supporting arm.

The end of the torsion coil spring engaging the prolongation has, in a preferred further development of the invention, a terminal portion bent at approximately right angles into a position parallel to the hinge link pintles. The tension of the torsion coil spring is therefore transmitted to the prolongation linearly along the bent-over terminal section, thereby achieving comparatively low friction and hence also low wear between the prolongation and the terminal portion of the spring. The second end of the torsion coil spring thrusts preferably against the pintle at the supporting arm end of the inner hinge link. Alternatively, however, this end can also thrust against the supporting arm itself, for example against the web between the sidewalls of the supporting arm.

Figure 2:
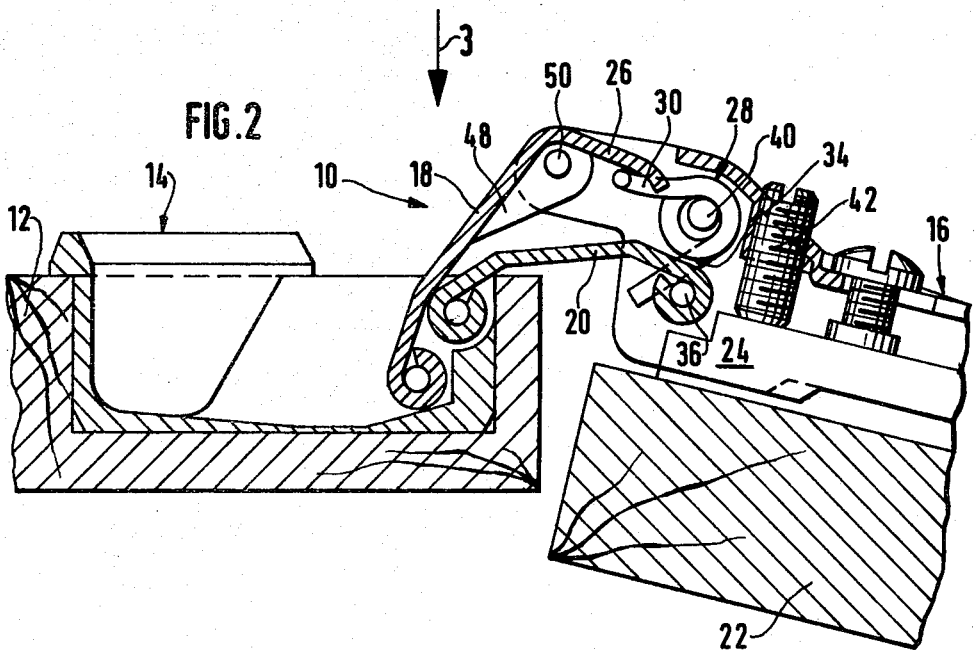
Figure 3:
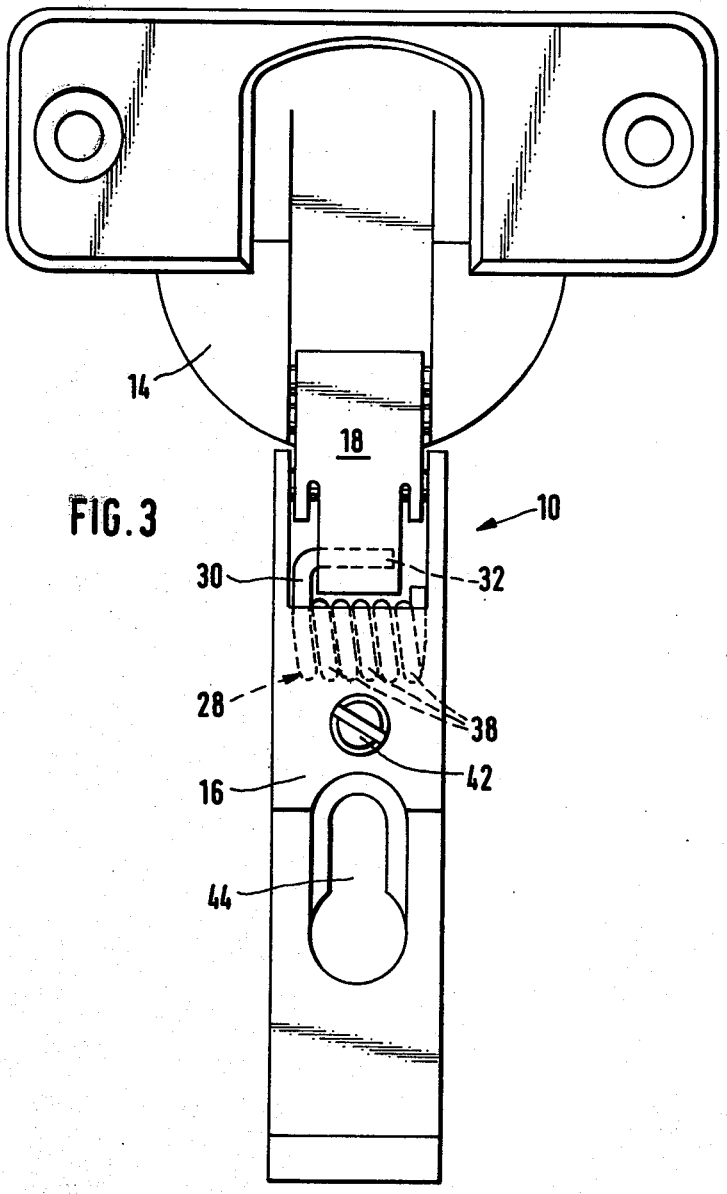

The invention will be further explained in conjunction with an embodiment thereof, with reference to the drawing wherein:

FIG. 1 is a cross sectional view taken through the central longitudinal plane of an embodiment of an over-center hinge of the invention, shown in the closed position, FIG. 2 is a cross sectional view corresponding to FIG. 1, taken through the over-center hinge of the invention illustrated in FIG. 1, shown in the open position, and FIG. 3 is an elevational view of the over-center hinge shown in FIGS. 1 and 2, as seen in the direction of the arrow 3 of FIG. 2.

The hinge of the invention shown in FIGS. 1 to 3 and designated as a whole by the number 10 is what is known as a quadruple knuckle joint hinge in which the door-related member, in the form of a hammer-in or snap-in cup 14 inserted into a matching mortise in the cabinet door 12 is articulated to the wall-related member in the form of an elongated supporting arm 16 by means of two hinge links 18 and 20. The supporting arm 16 is mounted on the sidewall 22 of the cabinet in a known manner on a mounting plate affixed to the sidewall 22. To this extent the hinge 10 is the same as conventional quadruple knuckle-joint hinges.

The over-center mechanism of hinge 10 has a prolongation 26 at the supporting arm end of hinge link 18 and a torsion coil spring 28 disposed in the interior of the supporting arm, whose one leg 30 thrusts, with its terminal section 32, which is bent over at right angles to a position parallel with the pintles of the hinge links, against the underside of the prolongation 26. The second leg 34 of the torsion coil spring 28 thrusts, in the illustrated case, against the pintle 36 at the supporting arm end of the inner hinge link 20. A pin 40 passing through the spirals 38 of the torsion coil spring and riveted in bores in the supporting arm sidewalls mounts the torsion coil spring irremovably in the desired position within the supporting arm 16.

When the door 12 is swung from the closed position shown in FIG. 1 to the open position shown in FIG. 2, the prolongation of the hinge link 18 first performs a clockwise pivoting movement against the bias exercised on it by the leg 30, the tension of the torsion coil spring at first acting against this swinging movement, i.e., exerting a closing torque through the prolongation 26 upon the hinge link 18. After the door has been opened to a certain angle, the swinging movement of the prolongation 26 reverses as the door continues to open, due to the cinematic relationships of the quadruple knuckle joint formed by the hinge links. Then the tension of the torsion coil spring 28 acts, therefore, in a direction to assist the opening movement, i.e., through the prolongation 26 it exerts an opening torque on the hinge links 18. It can be seen that, in the above-described pivoting movement of the prolongation 26 as the door is opened, the effective lever arm acting on the prolongation 26, as measured between the point of engagement of the spring leg 30 and the pintle at the supporting arm end of the hinge link 18, becomes shorter when the door is in the intermediate positions, than it is in the end positions. This means, however, that the effective lever arm is greatest in the end positions, i.e., that the door is held by a relatively high torque in the end positions, while the closing or opening torque, as the case may be, is lesser in the intermediate positions in accordance with the shortening of the effective lever arm. This characteristic is desirable because on the one hand it brings it about that the door is held securely in the end positions, but on the other hand the abrupt snapping over of the door as it passes through the dead center position is prevented.

For the pivot on its supporting arm end, the outer hinge link 18 is provided adjacent its extremity with two sidewalls 48 bent at right angles, in which bores are provided for the pintle 50 riveted in the supporting arm and forming the axis of articulation for the hinge link. The otherwise conventional rolled bearing eye is thus, in the present case, replaced by the bores in the sidewalls 48, so that the material otherwise used for the bearing eye can be used for the formation of the prolongation 26.

I claim:

1. An over-center hinge for cabinet doors, comprising: two hinge links pivotingly joined, in the manner of a quadruple knuckle joint, at one end to a door-related hinge member and at the other end to a wall-related hinge member in the form of an elongated supporting arm; said supporting arm having a door end, said hinge in the swing from its closed position to its open position, being moved through a dead center position; a torsion coil spring; on one side of said dead center position said hinge being biased by the tension of said torsion coil spring toward the closed position and on the other side thereof said hinge being biased by the tension of said torsion coil spring toward the open position; a prolongation provided on that hinge link which is farther from the wall related hinge-member than the other, said torsion coil spring having a first leg disposed in the front terminal portion of the door end of the supporting arm and engaging said prolongation, said prolongation forming with the pivot axle at the supporting arm end of said one link a lever arm which is directed away from the pivot axle such that, when the hinge is in the closed position, it is biased for swinging in the closing direction and, when the hinge is in the open position, it is biased for swinging in the opening direction, said torsion coil spring being disposed between the pivot axes on the supporting arm ends of the hinge links, and having a second spring leg supported by said supporting arm, said first spring leg having a terminal portion bent over approximately at right angles into a position parallel to the hinge link pivot axes, said second leg of the torsion coil spring being supported by the pivot axle on the supporting arm end of the hinge link closest to the wall-related hinge member, a pin holding said torsion coil spring in the supporting arm, said pin extending parallel to the pivot axes of the hinge links and passing through the spirals of the torsion coil spring.

2. An over-center hinge according to claim 1, wherein said pin holding the torsion coil spring in the supporting arm is riveted in bores in the side-walls of the supporting arm.

* * * * *